United States Patent [19]

VanMersbergen

[11] 4,444,535

[45] Apr. 24, 1984

[54] DUNNAGE PLUGS

[76] Inventor: Steve VanMersbergen, 8508 W. 45th Pl., #2-C, Lyons, Ill. 60534

[21] Appl. No.: 225,072

[22] Filed: Jan. 14, 1981

[51] Int. Cl.[3] ..... B63B 25/24

[52] U.S. Cl. ..... 410/121; 493/904; 493/967; 493/968

[58] Field of Search ..... 410/154, 155, 156, 121, 410/122, 129; 206/586, 591, 593, 491, 491.1, 814; 229/DIG. 1, 42; 220/440, 445; 493/967, 968, 912, 913, 138

[56] References Cited

U.S. PATENT DOCUMENTS

| | | | |
|---|---|---|---|
| 1,821,692 | 9/1931 | Copeland | 206/586 |
| 2,914,235 | 11/1959 | Jones | 206/491 |
| 3,421,451 | 1/1969 | Brucks | 410/154 |
| 3,424,108 | 1/1969 | Vargen | 410/154 |
| 3,534,691 | 10/1970 | Carlomango | 410/155 |
| 3,645,214 | 2/1972 | McLaughlin | 410/154 |
| 3,850,112 | 11/1974 | Jaski | 410/154 |

*Primary Examiner*—Randolph Reese

*Assistant Examiner*—Gregory A. Beehner

[57] ABSTRACT

Improved embodiments of a blank for a dunnage plug which fills gaps between cargo and a side wall of a vessel or vehicle in which the cargo or lading is transported include a single sheet, preferably of corrugated cardboard, having cuts or slits, slots, perforations and bends positioned thereon for allowing portions of the sheet to be folded into a plurality of channels which intersect perpendicularly and interlock in a plurality of half cross-lap-joints to provide an extremely inexpensive structure having a designated thickness and being capable of withstanding substantial loads in compression without failure. Since the improved dunnage plug blank of the invention is assembled and disassembled without separation of the sheet into more than one piece, there is no tendency for portions of the dunnage plug to become lost at any time. Further, if the dunnage plug is disassembled it folds back into a single flat sheet for efficient storage. In use, the improved dunnage plug is adapted to be affixed to either a sidewall of the transporting vessel or vehicle, or a sidewall of the cargo.

17 Claims, 9 Drawing Figures

10
11
12
13
14
15
16
17
18
20
21
22
23
24
25
26
28
29
30
30a
31
31a
32
32a
34
34a
35
35a
40
41
42
43
44

12
13
14
15
16
20
21
22
26
28
29
30
30a
31
31a
32
35
35a
40
41
43
44

42
42
10
26
30
31
31
15
40
13
44
14
18
44
15
43
31a
28
30a
15
31a

DUNNAGE PLUGS

CROSS REFERENCE TO KNOWN RELATED PRIOR ART

Of cursory value the known prior art is:

| Invention | Pat. No. | class/sub-class |
|---|---|---|
| Brucks | 3,421,451 | 410/154 |
| Vargen | 3,424,108 | 410/154 |
| McLaughlin | 3,645,214 | 410/154 |
| JASKI | 3,850,112 | 410/154 |

None of the above, whether taken and viewed singly or in combination with each other, are believed to have a bearing on the patentability of any claim of this invention.

The application is related and corresponding to the disclosure No. P-57,919 filed Aug. 25, 1980 in Group 220 in the matter of a request for filing of application in a foreign country under 35 USC 184 (1952) and which is issued License No. 430743 on Sept. 8, 1980.

BRIEF SUMMARY OF THE INVENTION

The invention relates to dunnage plugs for filling spaces between cargo or lading and side walls or between cargo(s) of a vessel or vehicle in which cargo is transported in or by to prevent damage to cargo by stopping the lateral or side movement of same within the vessel or vehicle during transport. More particularly, this invention relates to an improved dunnage plug made from a single sheet of material, such as solid fibre, chipboard, boxboard, plastic or plastic composition, but preferably corrugated cardboard, by cutting, slotting, perforating and bending the single sheet until a space-frame or monocoquetype structure of predetermined thickness is formed. The structure is engineered to have sufficient strength against compression across the designated assembled or formed thickness to prevent cargo shift in the vessel or vehicle.

BACKGROUND OF THE INVENTION

Cargo very seldom fits into a vessel hold, railroad boxcar, or truck trailer or container so efficiently that no space exists between the cargo or lading and any side wall of the vessel or vehicle or between cargo. Even pellets on which presently so much cargo is mounted are found typically not made to be exactly evenly divisible into a conventional cargo load space. Also, the variance in size of individual cargo or product containers often results in what is termed as pallet underhang or overhang when the containers are palletized, thereby assuring that, in most cases, a gap, or gaps, will be present laterly or horizontally across a fully loaded cargo space. In order to prevent damage caused by goods shifting into these cargo space gaps during transit, dunnage plugs are used to fill the voids which exist between individual cargo containers, pallets, or between one side of a cargo container and a side wall of the cargo space, be it a vessel hold, railroad boxcar, truck trailer, or the like.

While dunnage plugs may be made from any light, inexpensive or waste-type material of choice, several heretofore known types of dunnage plugs have been made from laminated, corrugated cardboard and other paper products. Examples of such dunnage plugs are shown and described in U.S. Letters Patent listed above and whose disclosures are incorporated herein by reference or background data. It is known as shown by the Jaski patent, supra, that plugs can be made of sheets bent into U-shaped channels. The dunnage plugs disclosed are made from a plurality of cardboard sheets which are bent to form U-shaped channels, or channel-shaped structures, each having opposed parallel side members and a base or web extending perpendicularly between the side members along one edge of each. The plurality of channel members are arranged in parallel groupings with the groups being oriented perpendicularly to each other. The opposing parallel side members of the channels each include a plurality of parallel interior slots formed therein which extend inwardly from the outer long edges of the channels; and they are positioned such that the slots, and therefore the channel-shaped structures, may perpendicularly engage or interlock with each other in essentially half cross-lap-joints. The planes defined by the flat webs or bases of the respective channels are positioned in parallel spaced apart relation when the channels are interlocked. The interlocking groups of channels form structure which has strength against compression across the formed thickness of the plug. It should be noted that the corrugations in the cardboard are positioned, when the channels are folded, to run parallel across the gap to be filled. It is known that while corrugated cardboard does have some strength against a compressive force positioned perpendicular to the laminated joints therein, it has a much greater resistance against compression from a force directed parallel to the laminations or corrugations.

The multi-piece dunnage plugs, especially those plugs where the various pieces differ in size, have disadvantages in that some of the pieces may become lost on the loading docks, freight yards, or the like where these items are used or if one piece damaged entire unit is useless. Additionally, if the dunnage plugs are attached, such as by stapling, to the interior sides of a vehicle or vessel, the channels perpendicular to those having staples therein may separate from the stapled channel. For example, if the non-stapled channels happen to be struck on their side surfaces, or on end, by cargo as it is being loaded adjacent to a wall mounted dunnage plug. Free-standing dunnage plugs may be subject to moisture damage from flooring, collapsing and the like.

It is therefore an object, feature, and advantage of the present invention, generally stated, to provide a blank for a new and improved one-piece or unitary dunnage plug.

Another object and advantage of the present invention, generally stated, is the provision of an improved dunnage plug constructed from a single sheet of material, preferably laminated, corrugated cardboard, which may be assembled, disassembled and stored, either for initial use or reuse, as a single sheet.

It is a further object of the present invention to provide an improved one-piece blank for a dunnage plug which includes a plurality of intersecting, interfitting, interlocking U-shape channel structures wherein the planes defined by the webs or bases of the respective channels perpendicularly intersect.

SUMMARY OF THE INVENTION

The present invention is directed to a one-piece blank for a dunnage plug being a generally rectangular sheet of material which is slit and foldable including a primary channel support having a central web portion and a pair of opposing side portions extending therefrom. A plurality of secondary supports include at least a base which extends from the channel support and a leg extending from the base. The leg is foldable traversely across the primary support channel and engages same to form box-like structures having substantial strength against compression. And it is known that the greatest box compression strength is within its corners or right angle bends or folds, which in theory is the same structure intent of the unitary filler of the present invention.

BRIEF DESCRIPTION OF THE DRAWINGS

The features of the present invention, which are believed to be novel, are set forth with particularity in the appended claims. The invention may best be understood by reference to the following detailed description taken in conjunction with the accompanying drawings of presently preferred embodiments thereof, in the several figures of which like reference numerals identify like elements, and in which:

DETAILED DESCRIPTION OF THE PREFERRED EMBODIMENTS OF THE INVENTION

Figure 1:
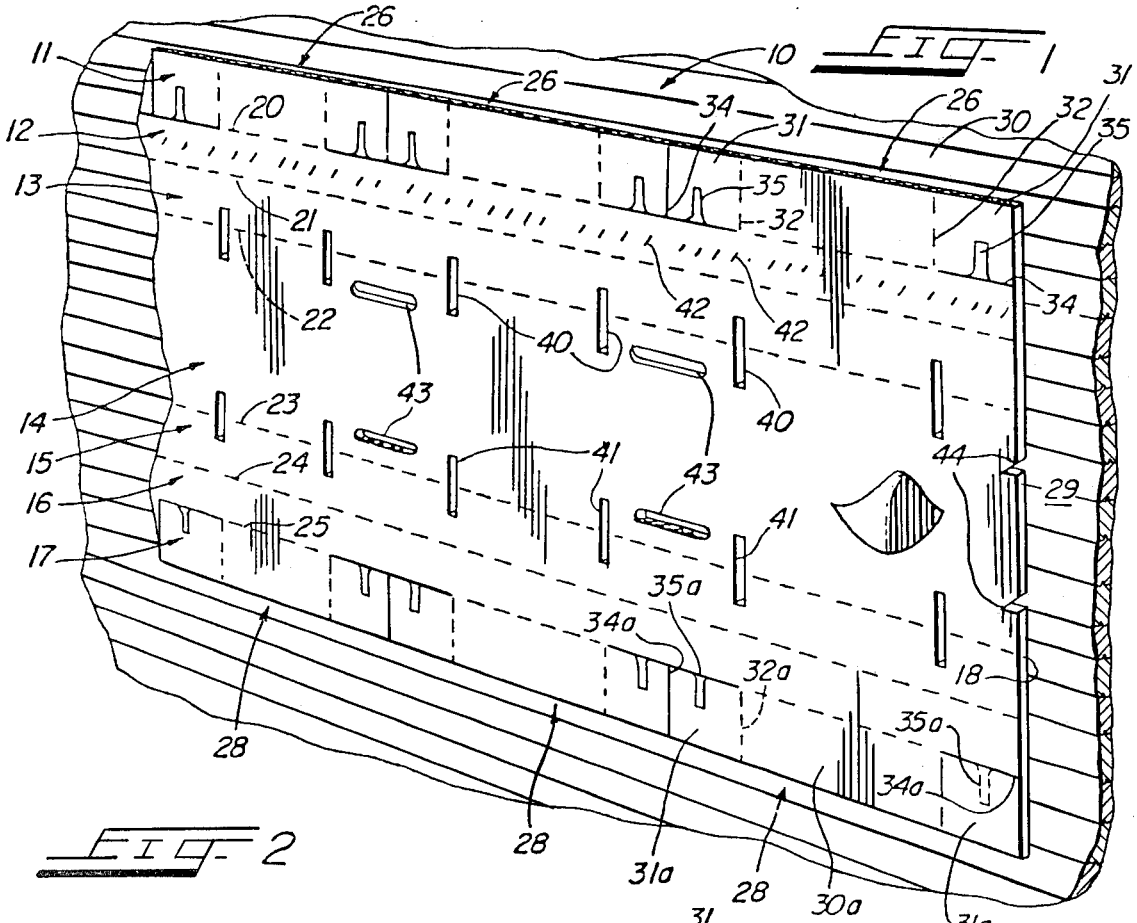
FIG. 1 is a fragmentary perspective view of a preferred embodiment of the present invention as it appears in unassembled sheet or blank form with a portion thereof retained on a side wall of a transporting storage compartment.
Figure 2:
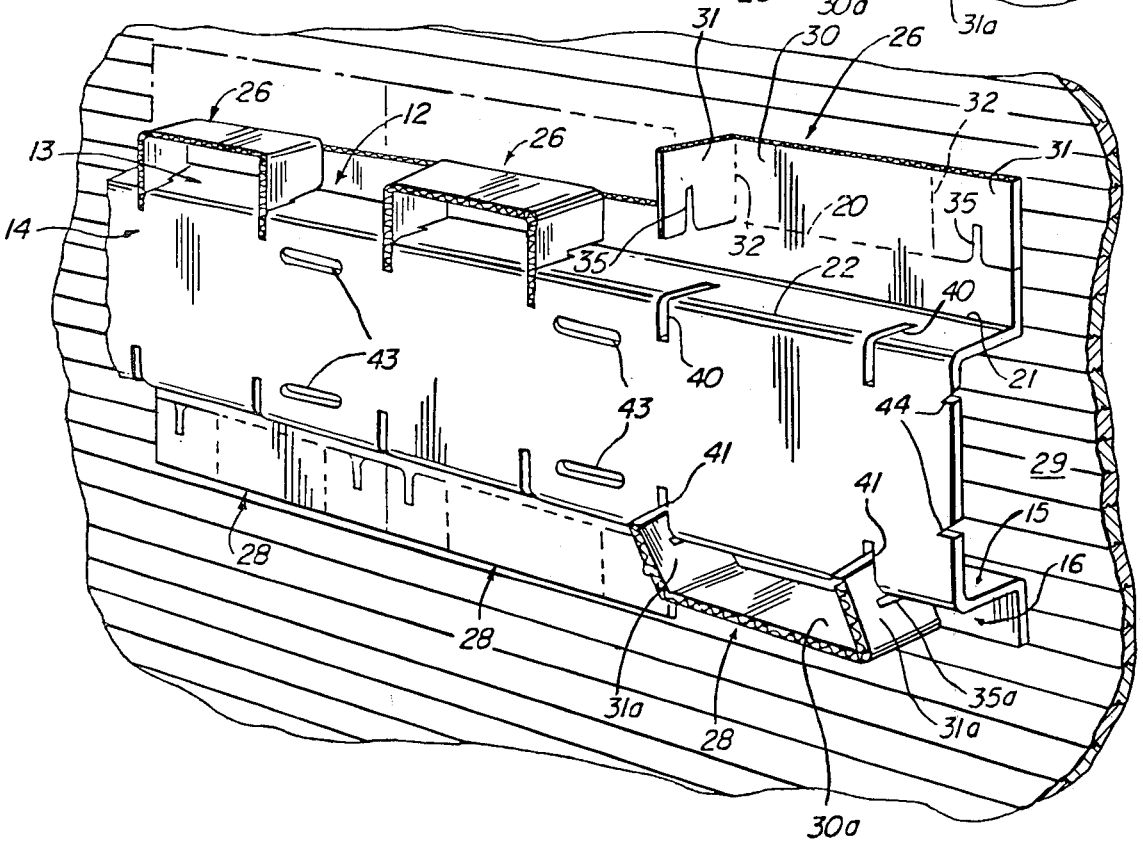
FIG. 2 is a fragmentary perspective view similar to FIG. 1 wherein the dunnage plug is in a state of partial assembly.
Figure 3:
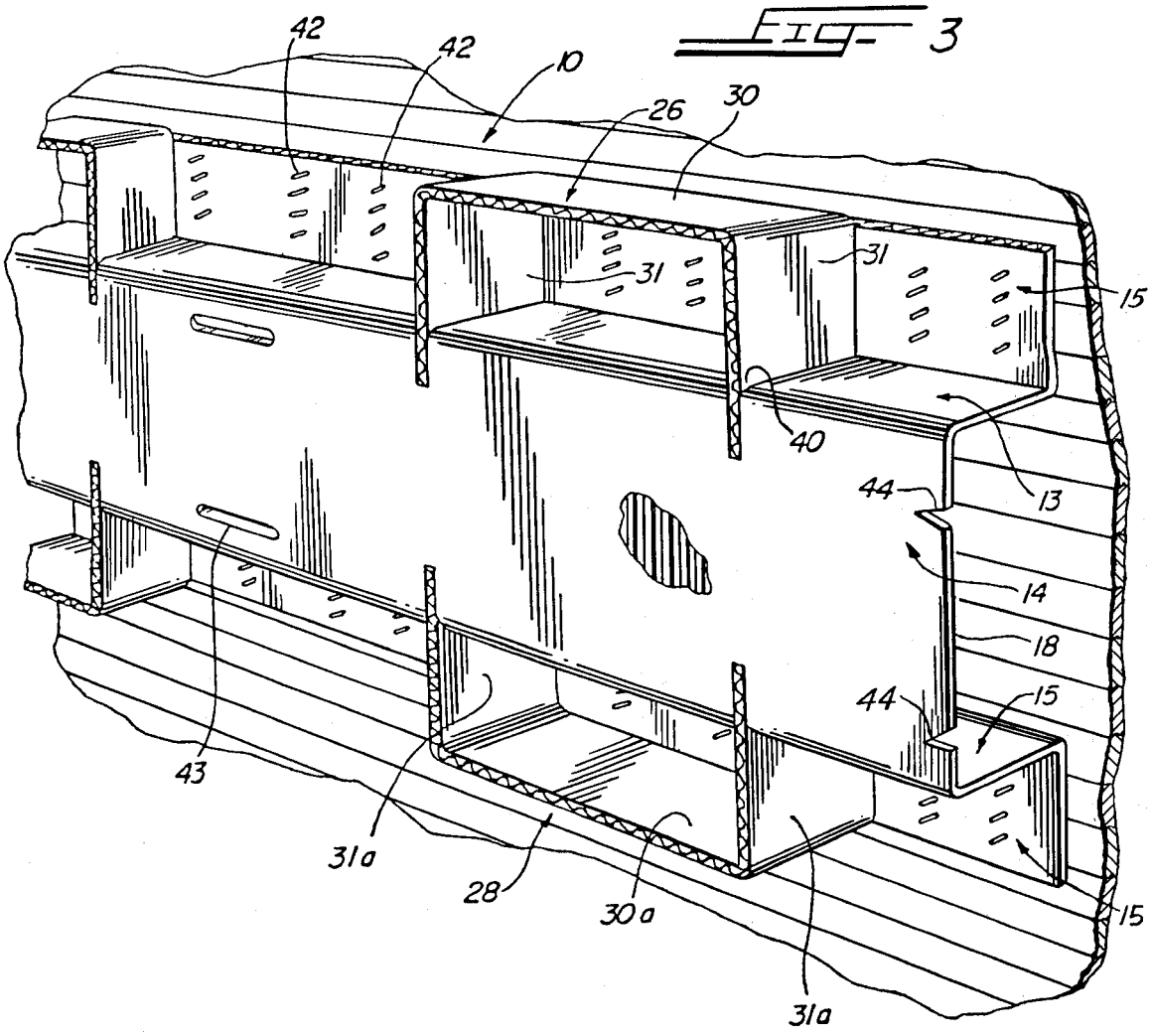
FIG. 3 is a fragmentary perspective view similar to FIGS. 1 and 2, but showing the dunnage plug as it appears when fully assembled.

Referring now to FIGS. 1-3, an improved single-piece dunnage plug blank 10 constructed in accordance with the present invention includes a plurality of elongate rectangular portions 11-17 which extend horizontally across the plug blank from one side edge 18 thereof to the other (not shown). The elongate rectangular portions 11-17 are arranged one after another in side-by-side adjacent relation with the divisions therebetween being horizontally oriented fold lines 20-25. It should be noted that portions of the fold lines 20 and 25 are cut through, and those portions will be explained in greater detail below. The opposing outside elongate rectangular portions 11 and 17 are mirror images of one another and are divided into a plurality of secondary members 26—26, 28—28 of which, for purposes of brevity, only one 26 will be discussed in detail. As one aspect of the present invention, secondary member 26 is defined by an internal web or base 30 attached to the remainder of blank 10 through fold line 20 and has leg members 31—31 extending from opposite sides thereof and divided therefrom by parallel vertical fold lines 32—32. Except for the fold lines 32, legs 31 are cut from the remainder of blank 10, with the cut portions being designated 34—34. As stated previously, portions of cuts 34 are extensions of fold lines 20, and portions are the distal end edges of the legs; although the blank side edge 18 forms a portion of one such edge. Additionally, an elongate slot 35 is cut out of each channel portion 31 and extends centrally vertically inwardly of the portion from the portion of cut 34 which is an extension of fold line 20. The purpose of slots 35—35 will be discussed below. The portions of secondary members 28 which are identical to those in channel 26, are indicated by the number associated with that part in channel 26 with the addition of a subletter "a" thereafter.

Another aspect of the present invention includes a pair of spatially related mounting portions 12 and 16 positioned immediately adjacent the respective outer portions 11-17. Upper mounting portion 12 is defined by fold lines 20 and 21 and the lower portion 16 is defined by fold lines 24 and 25. The purpose of mounting portions 12,16 will be discussed below. Interiorally adjacent to each of the mounting portions is a third aspect of the present invention, a three part primary channel portion composed of opposed channel walls or side members 13,15 positioned immediately interiorly adjacent the mounting portions 12,16, and separated therefrom by fold lines 21 and 24, respectively, and a central channel web portion 14. Web 14 is separated from upper side member 13 by fold line 22 and from lower side member 15 by fold line 23. A plurality of elongate slots 40—40 and 41—41 are positioned across and bifurcated by the respective fold lines 22 and 23, with approximately half of each slot 40 being positioned in side member 13 and half in web 14. Likewise, approximately half of each slot 41 is positioned in side member 15 and half in web 14. The slots 40,41 are also aligned with the respective secondary member fold lines 32—32. Further, the channel web 14 includes a set of two pairs of spaced apart horizontally oriented hand-hold slots 43—43 in order to facilitate the manual-carrying or of one or more plug blanks 10 and helps in assembly. It should be noted that a preferred material of choice for the dunnage plug blank is laminated, corrugated cardboard. Further, it is preferred that the laminations and corrugations therein be oriented vertically in the blank when same is in the position shown in FIG. 1.

In order to assemble or complete a dunnage plug from a blank 10 such as shown in FIG. 1, the central or primary horizontally oriented channel composed of web 14 and side members 15,16 is formed into a U-shaped by convex bending of the fold lines 22-23 between the channel members 13,15 and the web 14. It should be noted that all fold lines could be perforated as to allow assembly folds from either side of a flat blank and form a reversable assembly.

In order to align the mounting portions 12 and 16 with the interior surface 29 of a freight car, trailer, cargo hold, or the like, as shown most clearly in FIG. 2, concave bends are formed along fold lines 21,24, between the mounting portions and the respective primary channel side members 13,15. It should be noted that, in the preferred embodiment, the dunnage plug 10 is mounted by staples 42—42 or by their equivalent means well-known in the art to the surface 29. As shown most clearly in FIG. 1, the blank 10 may be stapled to the side wall prior to assembly assembled on wall itself; although, assembling the plug prior to securing same as shown in FIG. 3 is also within the scope of the present invention. When fully secured, it is preferred that the fasteners or staples on equivalent means 43 be mounted through both the top and bottom mounting portions 12 and 16.

Referring now to FIG. 2, after the primary horizontal channel is formed in blank 10, the secondary channels or members 26–28 are formed by bending their respective leg portions 31,31*a*, concavely with respect to the adjacent base 30,30*a*. The base of each secondary member is then bent along its respective folding line 20,25 concavely with respect to its adjacent mounting strip 12,16, to orient each such member perpendicularly to both the adjacent mounting strip, and the primary channel side member 13 or 15 closest thereto. As the bases 30,30*a* are folded, each of the respective channel side members 31,31*a* is aligned with and slides into one of the spatially related elongate slots 40—40 until the central slot 35 in each side member 31,31*a* engages one end of the respective adjacent slot 40 in interlocking relation in what is referred to in the trade as a half cross-lap-joint. This folding and interlocking procedure takes place with each secondary channel side member until, as most clearly shown in FIG. 3, the dunnage plug is completely formed. The perpendicularly interlocking relation between the secondary and primary channels provides a plurality of box-type structures which are particularly highly resistant to compressive forces directed perpendicularly to the plane defined by the central web 14.

It should be noted that, as assembled, the axes of the respective secondary members 26,28, or the plane defined by the base and leg portions, respectively, are oriented perpendicularly to a plane defined by central web 14. This is true of all the embodiments shown herein.

Figure 4:
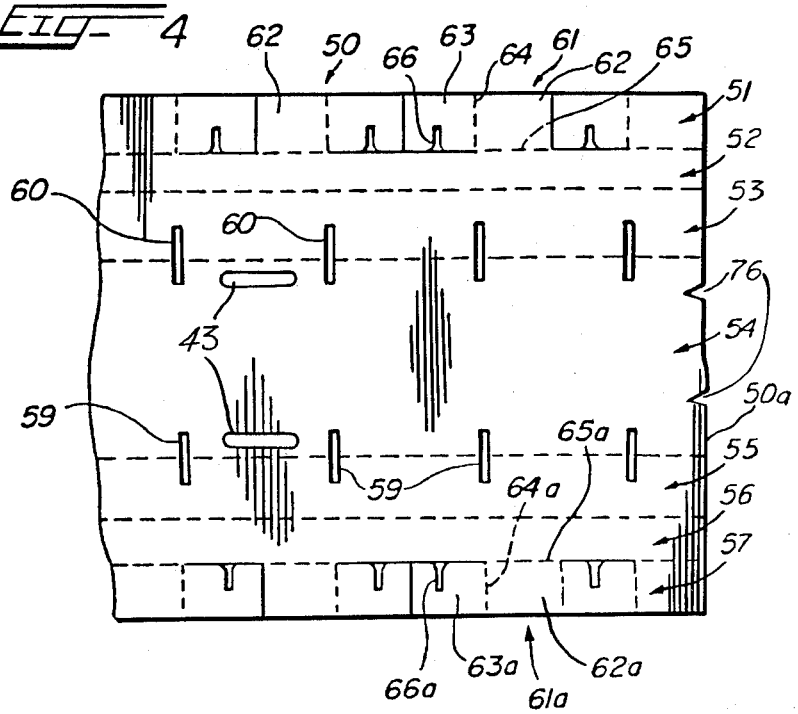
FIG. 4 is a fragmentary view of a second embodiment of the present invention shown as it appears in unassembled flat sheet form.
Figure 5:
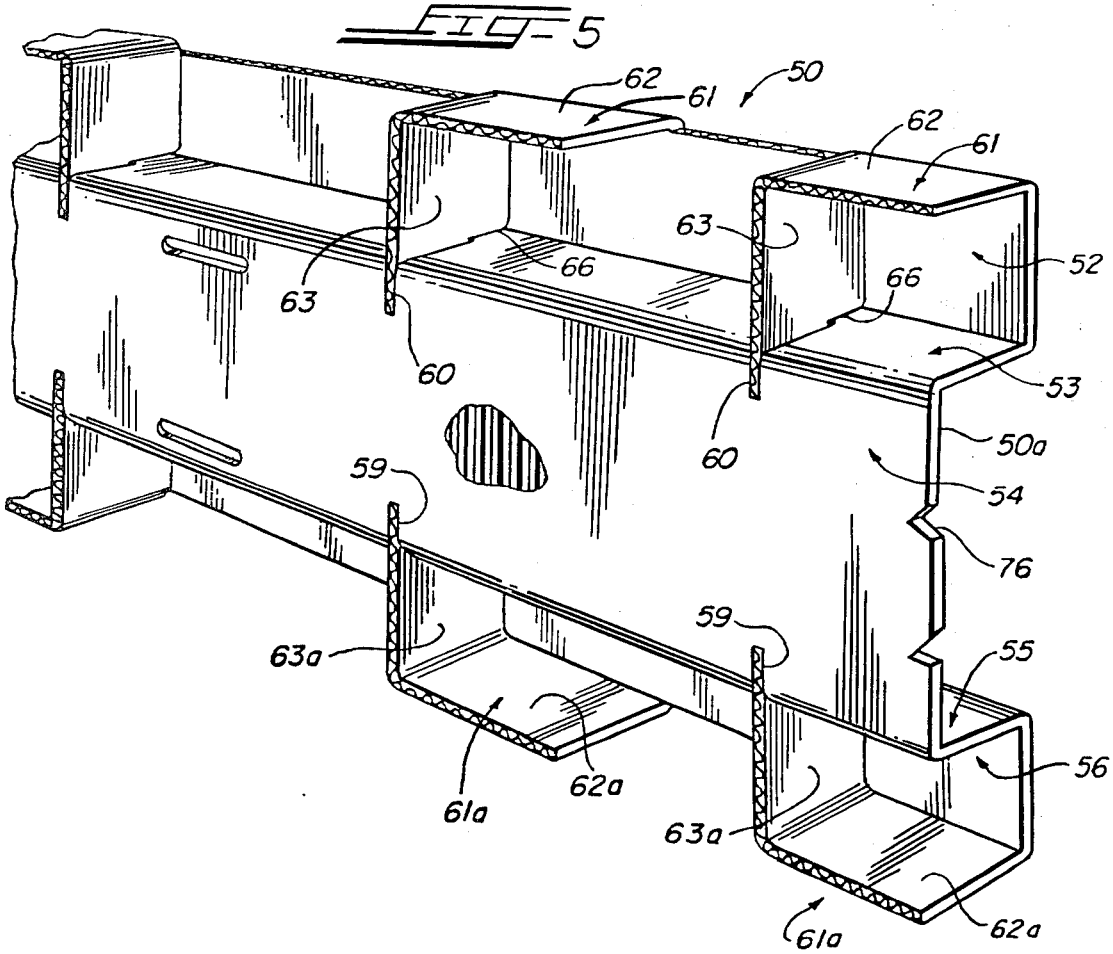
FIG. 5 is a fragmentary detail perspective view of the embodiment shown in FIG. 4 as it appears in assembled form.

Referring to FIGS. 4 and 5, a second embodiment of the improved dunnage plug blank 50 includes seven elongate rectangular portions 51–57 aligned side-by-side in similar fashion to the first embodiment of blank 10. The interior elongate portions 52–56 are identical to those shown and described in connection with the first embodiment, with the exception that the spatial relation between the individual elongate slots 59—59 and 60—60 differs from that found in the first embodiment. One aspect of the present invention disclosed in the embodiment is a difference in the outer opposed portions 51,57 from those shown and described in connection with the first embodiment wherein the secondary members define L-shape angles 61,61*a* rather than U-shaped channels. As with the previous embodiment, one such angle 61 will be described in detail. The opposing low or mirror image angle 61*a* are identified by the same number as used in angle 61 with the addition of the subletter a thereto. Each angle 61 includes a rectangular base 62 which is connected to the upper mounting portions 52 by fold line 65, and a generally rectangular leg portion 63 extending thereform and differentiated from the base by a fold line 64 positioned therebetween. As in the first embodiment, the leg 63 has a periphery, excepting for fold line 64, which is cut from the remainder of the plug blank 50. Likewise, leg portion 64 includes a slot 66 which is positioned therein similarly to slot 35 in leg 31 and has a function identical thereto. Additionally, the second embodiment includes a V-shape notch 76, which is formed in the opposing side edges, only 50*a* shown, and functions as a centerline locator. All embodiments contain a pair of U-notches (or center locators 44) to allow correct assembly up-side down.

It should be noted that the orientation of the angles 61,61*a* in dunnage plug 50 forms a mirror image on opposing sides a horizontal center line A—A of the blank. The secondary support members or angles are oriented in groups of 2 such that on the left-hand side of the sheet the angles have their open sides facing left and, on the right-hand side of the sheet the angles have their open sides facing right, with the interior groups thereof positioned in alternating orientation.

Assembly of the dunnage plug blank 50 is very similar to that shown and described in connection with the first embodiment 10 above, with the exception that only one leg 63,63*a* is folded with respect to each base 62,62*a*, respectively. Otherwise, the primary channel 53–55 is formed in the same manner as described above in connection with the first embodiment, as are the mounting portions 52,56 which extend from the opposed sides of the channel. Also, similarly as in the first embodiment, the distal ends of the respective legs 63,63*a* are insertable into the respective slots 59,60 adjacent thereto and the respective leg slots 66,66*a* are capable of interlocking with the elongate slots to form half cross-lap-joints as shown most clearly in FIG. 5. The completed dunnage plug 50 is, similarly to the dunnage plug blank 10, very resistant to compression forces in a direction perpendicular to the plane of central web 54.

Figure 6:
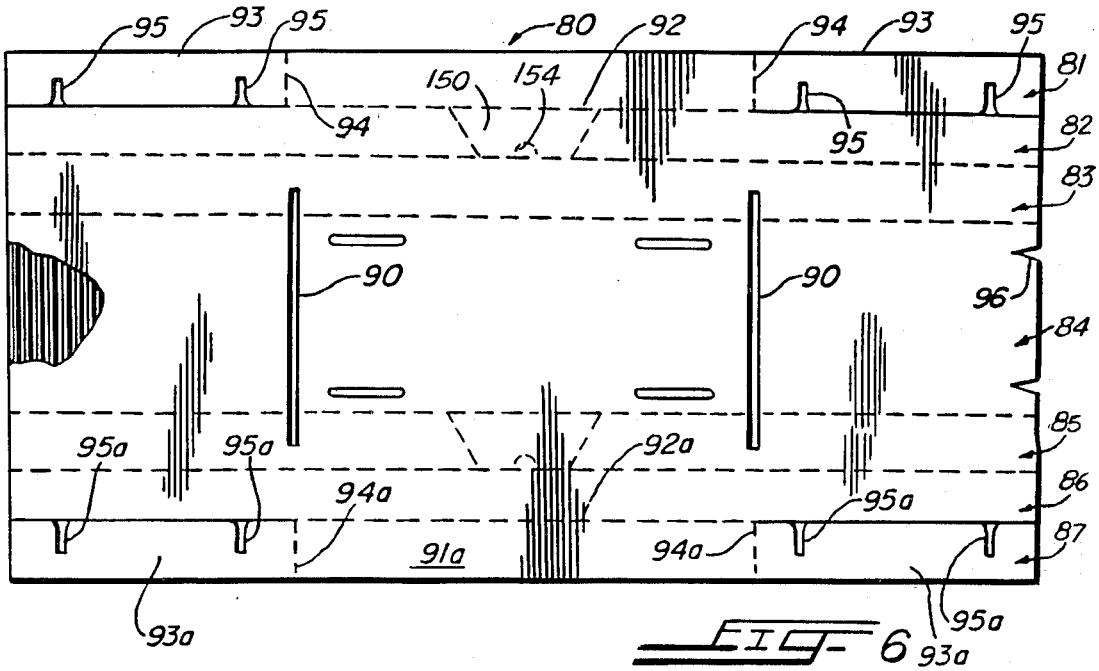
FIG. 6 is a view of a third embodiment of the present invention as it appears in unassembled flat sheet form.
Figure 7:
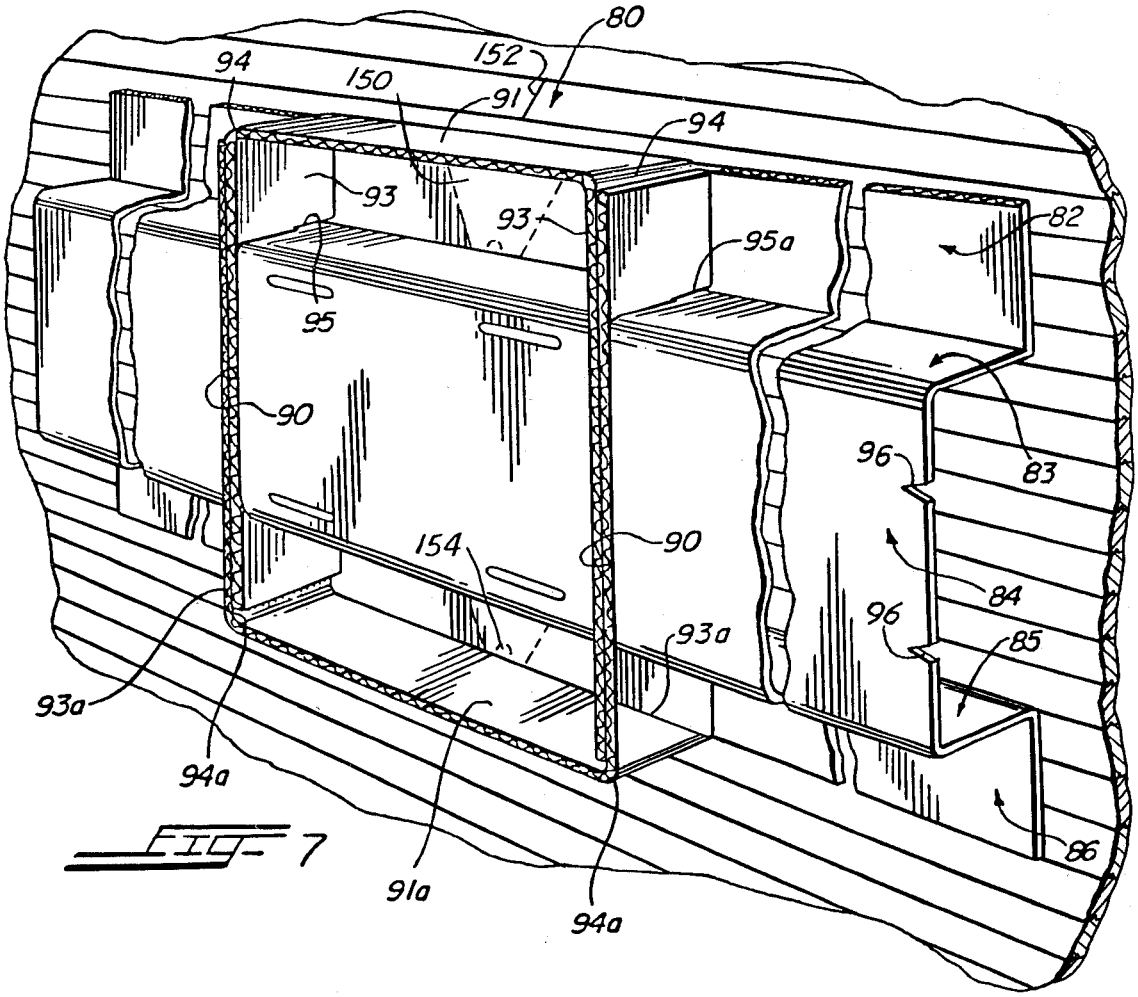
FIG. 7 is a fragmentary detail perspective view of the embodiment shown in FIG. 6 as it appears in fully assembled form.

Referring to FIGS. 6 and 7, a third embodiment of the dunnage plug blank of the present invention, indicated generally at 80, includes a plurality (seven) of elongate rectangular portions 81–87 which extend side-by-side horizontally across the blank similarly to those shown in connection with the first and second embodiments. Rectangular portions 82–86 are substantially similar in size and orientation to the interior portions 12–16 of the first embodiment, with the exception that the length and spacing of the slots 49–41 shown in the first embodiment. Elongate slots 90 bridge vertically and completely across the primary web 84 and extend approximately half way across the respective primary channel side members 83,85, respectively. The slots 90 are elongated to accommodate changes made to the secondary channels 81,81*a*. Taking rectangular portion 81, which is the mirror image of portion 87, and enumerated with respect thereto using subletter "a" as in the previous embodiments, the portion has been cut and is foldable to form one single U-shaped channel or channel-shaped member having a central web 91 which is attached to top mounting portion 82 across fold lines 92 and has a pair of elongate legs 93—93 extending from each of its opposed sides and separated therefrom by fold lines 94—94. The remainder of each secondary channel, leg 93 is cut from the dunnage plug blank 80 to define an elongate rectangle having thereon a pair of spaced apart slots 95—95 which extend inwardly from a portion of the periphery of the leg which is an extension of fold line 92. The space between each slot 95—95 in a channel leg 93 is identical to the vertical dimension of central primary web 84 as measured along slots 90.

Assembly of the third embodiment dunnage plug blank 80 is substantially similar to that described in connection with the two prior embodiments. The central channel 83–85 is formed identically as with the prior embodiments and each secondary channel 81,87 is formed identically as a secondary channel 26,28 in the first embodiment. However, when each secondary channel leg 93,93 is inserted in a proper elongate slot 90, both of the shorter slots 95 or 95*a* thereof interlock with one of the opposing ends of the slot 90 to form dual, spaced apart half cross-lap-joints. Also, in this embodiment, the respective slots 90 are twice as wide as the elongate slots of the prior two embodiments, as the opposed channel portions 93,93*a*, when assembled, are positioned in juxtaposed side-by-side relation in each slot 90. As shown most clearly in FIG. 7, the dual thickness of corrugated cardboard provided by the touching juxtaposed channel legs provide a very strong resistance against a compressive force which is oriented perpendicular to the plane of primary channel web 84.

Trapezoidal placement tabs 150 shown in FIGS. 6 and 7 are provided in which the base of the trapezoidal tab is contiguous with the fold line between rectangular portions 81, 82 or 85, 86. FIGS. 6 and 7 illustrate only a portion of a void filler or dunnage plug. A flute wire 152 may be inserted within a flute of the placement tabs to add rigidity to the tabs and assist in it being secured between an upper and a lower tier, or between adjacent sets of containers or tiers to which it may be applied. A semicircular notch 154 for receiving a thumb or finger aids in the removal of the tab 150 from the panel as may be desired or required.

Figure 8:
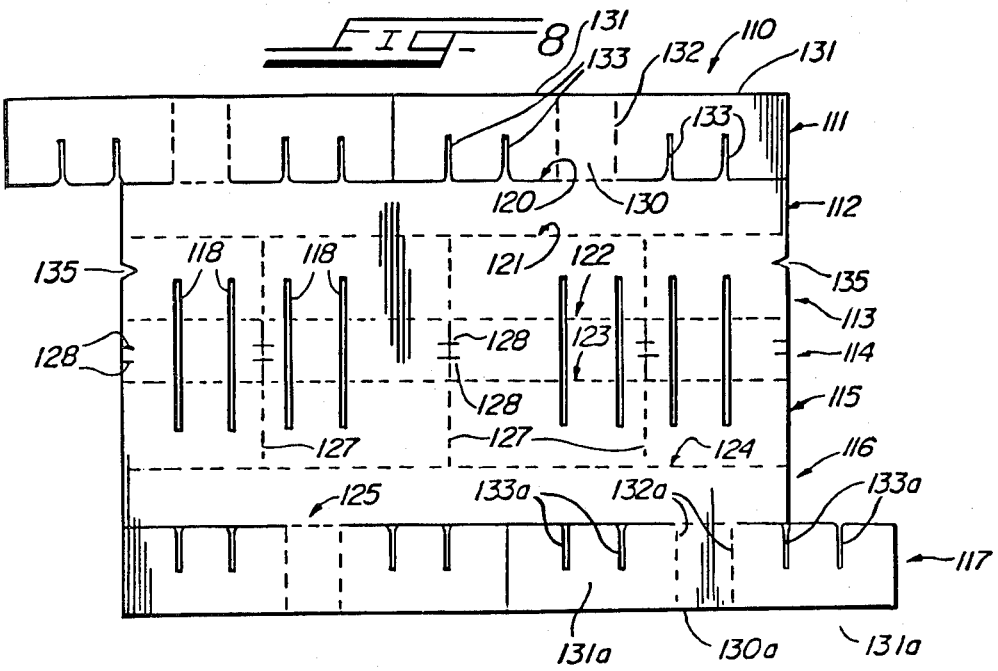
FIG. 8 is a view of a fourth embodiment of the present invention as it appears in unassembled flat sheet form.
Figure 9:
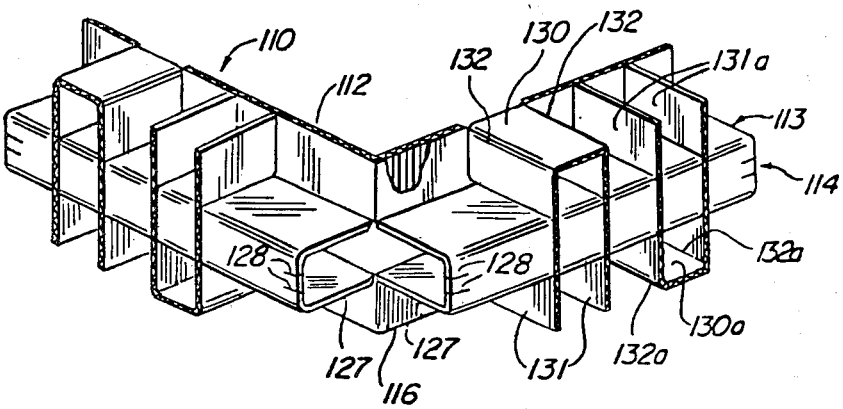
FIG. 9 is a perspective view of the embodiment shown in FIG. 8 as it appears in fully assembled form and adapted to be retained on an outside corner of a cargo unit.

Referring to FIGS. 8 and 9, a fourth embodiment comprises of the dunnage plug blank 110 and, as in the previous embodiments, when positioned in open blank sheet form includes a plurality of elongate rectangular portions 111–117 which extend horizontally side-by-side across the sheet blank and which are separated by fold lines 120–125, respectively. The number and function of each of the respective portions 111–117 is the same as in prior embodiments, however, in this embodiment, the vertical dimension of the central primary channel 114 is smaller than shown in the prior embodiments. As in the prior embodiments, the outer secondary channel portions 111–117 are changed slightly in position and dimensions from those previously described, and the elongate slots 118—118 which extend across the central web portion 114 to the primary channel side members 113–115.

A typical secondary channel member 130 which forms a segment of the upper rectangular portion 111 includes a base 131 separated from mounting portion 112 by fold line 120 having a pair of legs 131—131 extending from opposing sides thereof and differentiated therefrom by fold lines 132—132. The legs 131—131 are substantially longer than the channel web 130, and, as in the third embodiment of FIGS. 6 and 7, the remainder of each leg is cut from the plug blank and includes a pair of spaced apart slots 133—133 which are positioned and function identically as the spaced apart slots 95—95 thereof. The secondary channels 130, but otherwise they are the mirror image of same and are numbered likewise with the exception of a subletter "a". The fourth embodiment also includes centerline locating notches 135—135 which were also shown in connection with the second embodiment.

Referring to FIG. 9, the dunnage plug of the fourth embodiment is assembled in a manner substantially similar to the assembly of any of the prior embodiments. The primary channel 113–115, is formed in a U-shape; the opposed mounting portions 112,116 are extended vertically from the sides of the primary channel; and the secondary channels 130,130*a* are folded to extend across the primary channel similarly to the extension of the secondary channels as shown in connection with the third embodiment of FIG. 7 wherein each secondary channel leg 131,131*a* is interlocked with the opposing ends of a slot 118 in the primary channel.

An important aspect of the invention shown in the fourth embodiment includes a plurality of vertical perforations 127—127 which are positioned vertically traversely across the primary channel 113–115 in spaced relation to each other. After the dunnage plug 110 is assembled, as in prior embodiments, one or more of the perforation lines may be split in order to allow the dunnage plug to extend around the essentially 90° corner of a container or an essentially 180° to obtain a double thickness. In this embodiment, the dunnage plug may also be related on and become a portion of the cargo or lading as well as be retained on the interior side wall of a vessel or vehicle. Additionally, the primary channel web 113–115 includes a pair of spaced apart slits 128—128 which bridge across each of the perforations 127 perpendicularly thereto for a short distance (approximately an inch or two). The purpose of slits 128—128 is to form a groove therebetween in which a metal or other type strap may be retained. Since the dunnage plug 110 of the fourth embodiment may be retained on the cargo directly onto the vessel or vehicle, added efficiency is provided in cargo loading. The plurality of perforation lines 127 provide for adjustable mounting to the cargo or lading depending upon the differing sizes thereof and the locations which the cargo will be positioned on the vessel or vehicle during shipping. It should be noted that the dunnage plug 110 of the fourth embodiment may also be utilized, similarly to the first three embodiments previously described, if mounted on the vessel or vehicle interior side walls without the necessity of splitting the perforation lines.

The locator notches 135—135, as well as notches 76—76 of the second embodiment are positioned vertically above or below the centerline of a flat blank sheet a distance equal to the thickness of an assembled dunnage plug. When mounting plugs on a side wall, it is preferred that the assembled plug be positioned vertically across a juncture of cargo container layers. For example, if a cargo container is 4 feet high and the containers are packed 2 high in a trailer, it is preferred to mount the plug on a wall so its horizontal centerline, when assembled, is 4 feet high from the floor. In that position, the top half of the plug touches and restrains a top container and the lower half of the plug touches the bottom container. During assembly, the blank is positioned on the side wall with the notches being 4 feet from the floor and the top mounting strip 112 is stapled to the wall in that position when the plug is folded and assembled, as described above, the centerline of the plug, as assembled, will be 4 feet from the floor. Positioning tabs also is for same placement without attachment to walls.

Thus, it is seen that the unitary or single piece corrugated cardboard dunnage plug blank of the present invention may be utilized in several variations depending upon a specific cargo or lading to be transported and the specific dimensional relations between the cargo and the vessel or vehicle in which the same is to be shipped. The dimensions of the dunnage plugs of the invention described may be varied to fit the needs of the individual users.

While at least four particular embodiments and variations of the invention have been shown and described, it will be obvious to those skilled in the art that changes and modifications may be made without departing from the invention in its broader aspects. Therefore, the aim in the appended claims is to cover such changes and modifications as may fall within the true spirit and scope of the invention.

What is claimed and desired to be secured by Letters Patent of the United States is:

1. A blank for a dunnage plug comprising:

a unitary, substantially rectangular sheet of material;

primary support channel means on said sheet defining a central web portion and pair of side members extending from opposing sides thereof and adapted to be folded into a channel-like structure;

said opposing side members each in addition comprising a mounting strip extending substantially the length of said side member adjacent a boundary of said side member and opposite a juncture between said central web and said side member, said mounting strip being foldable relative the remainder of said side member for adapting said plug, when formed, to be mounted on a substantially flat external surface;

a plurality of secondary support means, including at least a base extending from said primary support channel means and a leg member extending from said base; and said leg member being foldable transversely across portions of said primary support channel means in retaining engagement therewith for forming box-like structures having substantial strength against compression.

2. The dunnage plug blank as defined in claim 1 wherein, said primary support channel means is positioned substantially centrally on said sheet;

said secondary support means extend from opposing portions of said primary channel means; and said base of each said secondary support means, when in folded position, intersecting a plane defined by said primary support channel web.

3. The dunnage plug blank as defined in claim 1, wherein said secondary support means include, a secondary channel means having a base portion in communication with said primary channel means and a pair of leg members extending from respective opposing sides of said base; and said primary support channel means including a plurality of parallel spaced apart interior slots formed therein into which said secondary channel legs are adapted to be engaged when folded with respect to said base.

4. The dunnage plug blank as defined in claim 1, wherein respective ones of said secondary support means extend from opposing boundaries of said primary channel support means in aligned relation to each other.

5. The dunnage plug blank as defined in claim 1, wherein respective ones of said secondary support means extend from opposing boundaries of said primary channel support means in offset relation to each other.

6. The dunnage plug blank as defined in claim 1, wherein said primary channel portion includes, a line of perforations extending substantially traversely thereacross, with the exception of said mounting strips, for adapting said plug, when formed, to be mounted across a corner of a cargo load or lading.

7. The dunnage plug blank as defined in claim 1, wherein there is disposed on said mounting strips a trapezoidal placement tab including a semicircular notch hole for removal from the blank and in which the tab assists in the application of the dunnage plug.

8. The dunnage plug blank as defined in claim 7, wherein a flute wire is inserted within said placement tab.

9. A dunnage plug blank comprising:

a single generally rectangular sheet of material including an elongate primary channel portion extending substantially the length of said sheet and having a central web and a pair of side members extending from the opposing longer sides of said central web with each of said side members including at least one slot formed therein, said side members being foldable relative said web along a line of communication therebetween;

a plurality of elongate secondary reinforcing portions extending from said primary channel portion with each including a base portion and at least one leg extending from said base, each said leg including a slot formed therein which is in communication with a periphery thereof, said leg being foldable relative said base along a line of communication therebetween and said base being foldable relative said primary channel portion along a line of communication therebetween, said base adapted to be, when in folded position, substantially parallel to said side members, and said leg being adapted to be, when in folded position, retained on at least one of said side member slots with said slot in said leg engaging same.

10. The dunnage plug blank as defined in claim 9, wherein said primary channel portion further includes a pair of elongate mounting strips being aligned with said side members thereof, extending outwardly thereof, said being foldable with respect thereto along a line of communication therebetween, and said bases of said secondary reinforcing portions extending from the respective ones of said mounting strips.

11. The dunnage plug blank as defined in claim 10, wherein said central web and said opposing side members include a line of perforations extending thereacross substantially perpendicular to the length thereof for adapted said plug to be secured to a corner of a cargo or lading.

12. The dunnage plug blank as defined in claim 11, wherein said central web further includes parallel relatively closely spaced slots extending across said line of perforations for defining a recess adapted to receive a banding member when said plug is secured to a cargo load.

13. The dunnage plug blank as defined in claim 9, wherein each of said secondary reinforcing portions include a pair of opposed legs extending from said base and defining therewith a secondary channel.

14. The dunnage plug as defined in claim 9, wherein said slot in one of said side members extend across said central web into said other side member and defines said slot therein;

each of said legs include a pair of substantially parallel space apart slots therein; and said slots in said leg being adapted for engagement, respectively, with the opposing ends of said slot extending across said central web.

15. The dunnage plug blank as defined in claim 9, wherein said base portions extending from opposing sides of said primary channel portion are positioned in aligned relation.

16. The dunnage plug blank as defined in claim 9, wherein said base portions extending from opposed sides of said primary channel portion are positioned in offset relation.

17. The dunnage plug blank as defined in claim 9, wherein said central web includes locator notches positioned on the respective opposing and edges thereof a distance from the horizontal centerline of said blank equal to the assembled thickness of said plug.

* * * * *